United States Patent [19]

Peterson

[11] 4,066,206

[45] Jan. 3, 1978

[54] CONTINUOUS ENVELOPE ASSEMBLY

[75] Inventor: Charles L. Peterson, Crystal Lake, Ill.

[73] Assignee: Uarco Incorporated, Barrington, Ill.

[21] Appl. No.: 780,005

[22] Filed: Mar. 22, 1977

[51] Int. Cl.[2] ..... B65D 27/10

[52] U.S. Cl. ..... 229/69; 282/11.5 A

[58] Field of Search ..... 229/69; 282/11.5 A, 282/11.5 R

[56] References Cited

U.S. PATENT DOCUMENTS

| | | | |
|---|---|---|---|
| 1,434,097 | 10/1922 | Conner | 229/68 R |
| 2,722,369 | 11/1955 | Reuter | 229/69 |
| 2,824,685 | 2/1958 | Patton | 229/69 |
| 3,026,018 | 3/1962 | Stratton et al. | 229/69 |
| 3,482,763 | 12/1969 | Carrigan | 229/69 |
| 3,547,343 | 12/1970 | Alton | 229/69 |
| 3,580,488 | 5/1971 | Komen | 229/69 |
| 3,786,984 | 1/1974 | Malenge | 229/69 |
| 3,790,068 | 2/1974 | Stutz | 229/69 |

*Primary Examiner*—Stephen P. Garbe

*Attorney, Agent, or Firm*—Wegner, Stellman, McCord, Wiles & Wood

[57] ABSTRACT

An improved continuous envelope assembly including an elongated ply of paper having control punch margins along longitudinal edges thereof, individual envelopes in the assembly being delimited by transverse lines of weakening extending across the assembly, die cuts in the ply adjacent both longitudinal edges thereof and adjoining the lines of weakening at one side thereof to define the corners of envelope flaps, first glue lines on the ply adjacent the lines of weakening and on the sides thereof opposite the die cut, individual sheets having widths less than the ply and lengths less than the distance between the lines of weakening secured to the ply by the first glue lines, the ply longitudinal edges being folded over the longitudinal edges of the individual sheets, second glue lines securing the ply longitudinal edges to the sheet longitudinal edges, the control punch margins being reverse folded away from the sheets to extend to the sides of the respective sheets longitudinal edges.

5 Claims, 5 Drawing Figures

Fig. 1
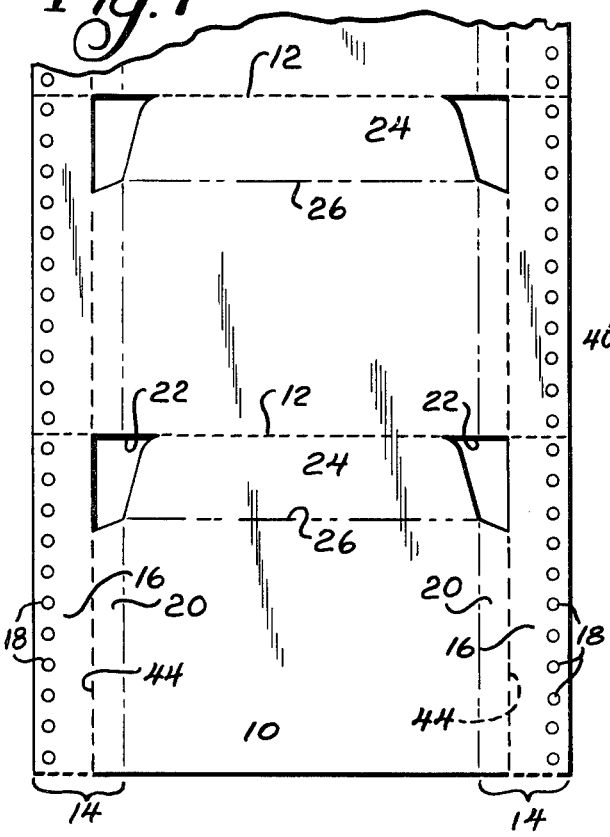
Fig. 2
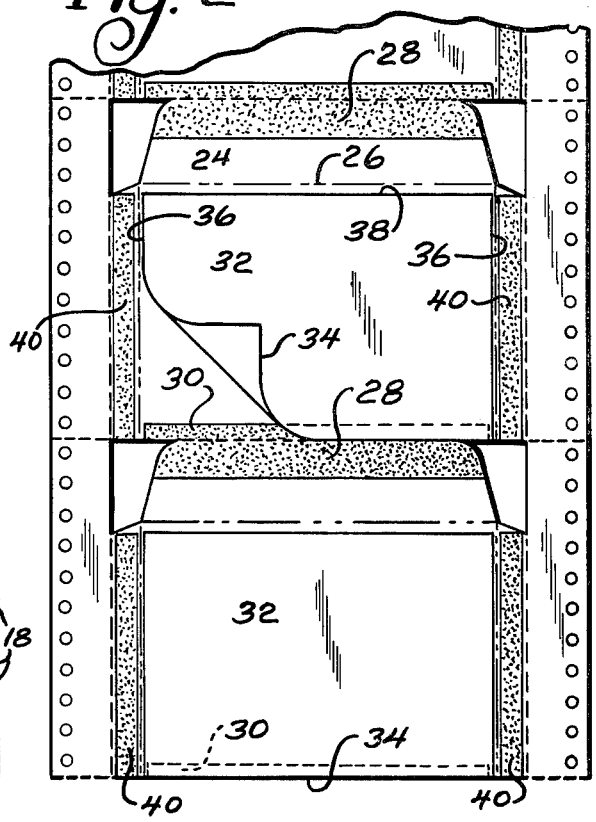
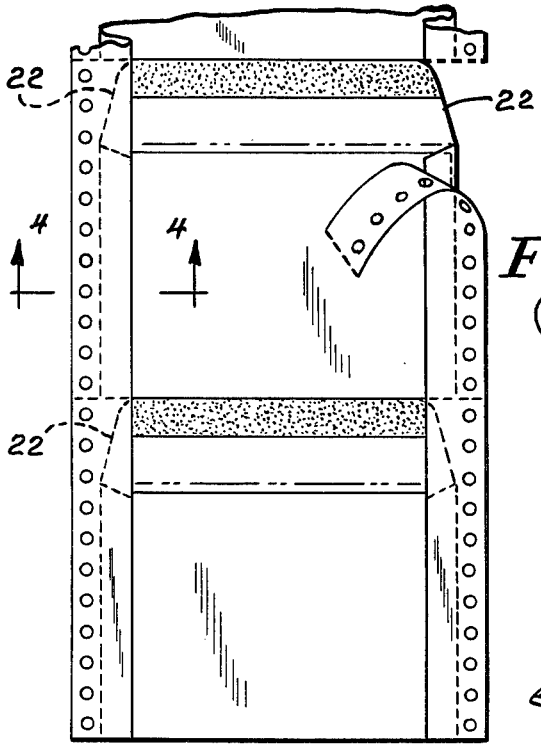
Fig. 3
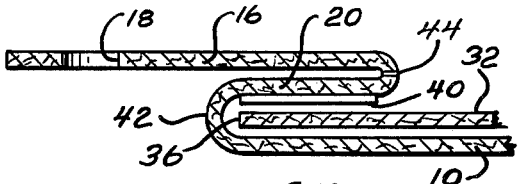
Fig. 4
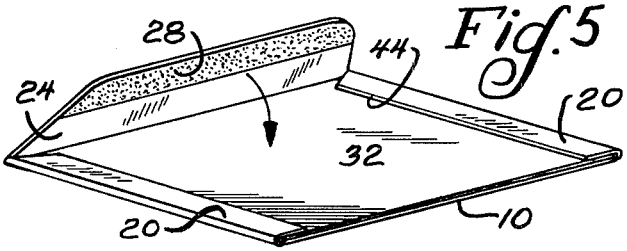
Fig. 5

CONTINUOUS ENVELOPE ASSEMBLY

BACKGROUND OF THE INVENTION

This invention relates to envelope assemblies, and, more particularly, to continuous envelope assemblies.

Prior art of possible relevance includes the following U.S. Patents: Reuter U.S. Pat. No. 2,722,369, issued Nov. 1, 1955; Patton U.S. Pat. No. 2,824,685, issued Feb. 25, 1958; Alton U.S. Pat. No. 3,547,343, issued Dec. 15, 1970; Komen U.S. Pat. No. 3,580,488, issued May 25, 1971; and Stutz U.S. Pat. No. 3,790,068, issued Feb. 5, 1974.

Continuous envelope assemblies have long been used for any of a variety of reasons. Their continuous nature allow the same to be easily fed through printers or the like for imprintation thereon of an address of the intended recipient. Similarly, their continuous nature allows the assemblies to be fed through stuffing equipment wherein the intended contents of the envelope are introduced into the pocket thereof. Generally, continuous envelope assemblies of the type mentioned in the preceding paragraph have fallen into two categories. The first is that wherein generally conventional envelopes are secured by any suitable means to carrier strips from which they are removed when about to be placed in the outgoing mail. A second category is represented by the patents cited above and includes such envelope assemblies where two sheets or plies are superimposed upon one another and glued together in such a way that each individual envelope will include a pocket defined by a U-shaped glue line. One ply will be provided with small die cuts to define the flap of the envelope, while the other ply will generally be provided with a large die cut which is aligned with the flap to allow the flap to be folded over the envelope after the contents have been received in the pocket defined by the U-shaped glue line.

Continuous envelope assemblies of the second category have been quite successful but are not totally without disadvantages. For example, the maximum width of the interior of the envelope is limited by the spacing between the legs of the U-shaped glue line with the consequence that such an envelope requires a larger overall width dimension to enclose the same size contents as could be received in a conventional folded envelope.

At the same time, the die cut on one ply made to allow the flap to be folded over the ply to seal the envelope requires the removal of a considerable amount of paper which cannot be utilized other than by recycling. Consequently, the cost of materials utilized to form such envelopes is greater than would be the case if such paper wastage could be eliminated.

In addition, when such envelopes are utilized in fast indexing printers, occasionally the die cuts utilized to form the corners of the flap may hang up on mechanical components of the printer causing shutdowns or requiring a reduction in flow speed, resulting in less than full use of the printer capacity.

SUMMARY OF THE INVENTION

It is the principal object of the invention to provide a new and improved continuous envelope assembly. More specifically, it is an object of the invention to provide such an assembly wherein the size of the interior of each individual envelope is increased over the prior art constructions so that the overall width of the assembly may be reduced and yet receive the same size contents; wherein material costs are minimized; and wherein the assembly will flow smoothly through fast indexing printers without hanging up.

An exemplary embodiment of the invention achieves the foregoing objects in a continuous envelope assembly comprising an elongated ply of paper having control punch margins along the longitudinal edges thereof. Individual envelopes in the assembly are delimited by transverse lines of weakening across the assembly and there are provided first glue lines on the ply adjacent the lines of weakening on one side thereof. Individual sheets having widths less than the ply are secured thereto by the first glue line and the longitudinal edges of the ply are folded over the longitudinal edges of the individual sheets. Second glue lines secure the ply longitudinal edges to the sheet longitudinal edges and the control punch margins are reverse folded away from the sheets to extend to the sides of the respective sheet longitudinal edges. As a consequence, the sides of the individual envelopes are defined by folds maximizing the width of the interior of the envelope.

According to a preferred embodiment, die cuts are provided in the ply adjacent both longitudinal edges thereof and adjoin the lines of weakening on the sides thereof opposite from the first glue lines to define corners of an envelope flap.

Preferably, the folded over ply longitudinal edges extend sufficiently inwardly on the assembly so as to substantially fully overlie the die cuts on the corresponding side of the assembly so that the same are not exposed to mechanical components of a printer and cannot hang up thereon.

In a highly preferred embodiment, means defining fold lines are located in the ply adjacent the edges of the sheets remote from the first glue lines to facilitate folding of the envelope flaps. Adhesive is placed on the envelope flaps.

Other objects and advantages will become apparent from the following specification taken in connection with the accompanying drawings.

DESCRIPTION OF THE DRAWINGS

FIG. 1 is a fragmentary plan view of an elongated ply utilized in forming envelope assemblies made according to the invention;

FIG. 2 is a view similar to FIG. 1 illustrating the construction at a further stage in the assembly thereof wherein glue lines and individual sheets have been applied to the ply;

FIG. 3 is a view similar to FIGS. 1 and 2 showing the construction in a further stage of the assembly wherein longitudinal edges of the ply and the control punch margins have been folded in a manner to be described in greater detail hereinafter;

FIG. 4 is an enlarged sectional view taken approximately along the line 4—4 of FIG. 3; and FIG. 5 is a perspective view of an individual envelope taken from the assembly of the present invention with the control punch margins removed.

DESCRIPTION OF THE PREFERRED EMBODIMENT

An exemplary embodiment of a continuous envelope assembly made according to the invention is illustrated in the drawings and, with reference to FIG. 1, includes an elongated ply 10 of paper or the like. Transverse lines of weakening 12 extend across the assembly and may be formed of perforations or the like. The transverse lines of weakening define the individual envelopes in the assembly and, as is well known, the individual envelopes may be separated from the assembly along the lines 12 either manually, or mechanically, as by conventional bursters.

The ply 10, at its opposite sides, includes longitudinal edges 14 which include outer, control punch margins 16 provided with pinfeed holes 18 in a conventional fashion, and inner, securing areas 20 for purposes to be seen. Adjacent both longitudinal edges 14 of the ply 10, there are provided die cuts 22 which adjoin the lines of weakening 12 on one side thereof to define the corners of an envelope flap 24. It is to be observed that the die cuts 22 include the entirety of the securing areas 20 from each side of the flap 24 and extend inwardly thereof a distance approximately equal to or somewhat less than the width of each securing area 20.

Lines of weakening 26, considerably stronger than the lines of weakening 12, extend across the ply 10 between the die cuts 22 to define fold lines whereby the flaps 24 may be easily folded over the corresponding individual envelope.

Referring now to FIG. 2, during the course of the assembly of the continuous envelope assembly, the upper edge of each of the flaps 24 is provided with a remoistenable adhesive 28 which is dried by any suitable means. After the adhesive 28 has been dried, adjacent each line of weakening 12, and on the side thereof opposite from the die cuts 22, there is provided a transverse glue line 30 which extends between the longitudinal edges 14 of the ply 10. Immediately after the application of the glue lines 30, individual sheets 32 are secured to the ply 10. As seen in FIG. 2, the bottom edges 34 of the individual sheets are adhered to the glue lines 30.

As can be seen from FIG. 2, the width of the individual sheets 32, defined by the distance between side or lonitudinal edges 36 thereof, is less than that of the ply 10 and will normally be equal to or just slightly less than the distance between the longitudinal edges 14 of the ply 10.

It will also be observed that the length of each individual sheet 32 is approximately equal to or just slightly less than the distance between the lines of weakening 12 and 26 so that the flap 24 may be folded over the upper edge 38 of the sheet 32.

After the sheets 32 have been secured to the ply 10, longitudinal glue lines 40 are placed on the securing areas 20.

As best seen in FIGS. 3 and 4, after the glue lines 40 have been located in the securing areas 20, the marginal edges 14 are folded inwardly so that the glue lines 40 overlie the longitudinal edges 36 of the sheets 32 and are secured thereto by the glue lines 40. Thus, folds 42 define opposed side edges of the individual envelopes in the assembly and it will be observed that there is no glue wihtin the pocket of the envelope at such side edges so that the internal width of the envelope pocket is maximized, maximizing the width of the contents to be received therein.

After the securing areas 20 are secured to the longitudinal edges 36 of the sheets 32 by the glue lines 40, the remainder of the longitudinal edges 14, namely, the control punch margins 16, are reverse folded on lines 44 which may be lines of weakening, if desired, such that the control punch margins 16 extend outwardly and to the side of the corresponding fold 42 to enable clear access to the pinfeed holes 18 for purposes of feeding the forms.

As can be observed from FIG. 3, preferably the width of the control punch margins 16 and the width of the securing areas 20 of each longitudinal edge 14 is such that the control punch margins 16 substantially completely overlie the die cuts 22 on one side of the envelope so that the edges of the die cuts 22 cannot catch on mechanical components of a printer through which the assembly is to be fed.

After printing of the envelopes, the control punch margins 16 may be removed from the assembly along the lines 44 by any suitable means. The individual envelopes forming the assembly may be separated from each other along the lines of weakening 12 as by bursting, stuffed, and, as seen in FIG. 5, the flap 24, after the adhesive 28 have been moistened, is folded over on the line of weakening 26 to seal the envelope.

From the foregoing, it will be appreciated that an envelope assembly made according to the invention provides a maximum interior width allowing either an increase in the width of the material to be received within the envelope or a decrease in the width of the stock being utilized to form the envelope to receive the contents of a given width. At the same time, it will be appreciated that since one side of the envelope is formed of individual sheets such as the sheets 32, there is no need for a die cut in a ply to be aligned with the flap 24 thereby eliminating the waste in material resulting from the use of such die cuts.

It will be appreciated that by reason of the fact that the die cuts 22 are completely covered on one side of the assembly by the control punch margins 16, the possibility of the assembly hanging up in a fast indexing printer is minimized and/or eliminated.

Finally, assemblies made according to the invention may be zig-zag folded as opposed to being placed in rolls as is the case with many prior art constructions, thereby retaining the storage, shipping and processing advantages associated with such folded forms.

I claim:

1. A continuous envelope assembly comprising:

an elongated ply of paper having control punch margins along longitudinal edges thereof;

individual envelopes in said assembly being delimited by transverse lines of weakening extending across said assembly;

die cuts in said ply adjacent both longitudinal edges thereof and adjoining said lines of weakening at one side thereof to define the corners of the envelope flap;

first glue lines on said ply adjacent said lines of weakening and on the sides thereof opposite said die cuts;

individual sheets having widths less than said ply and lengths less than the distance between lines of weakening secured to said ply by said first glue lines;

said ply longitudinal edges being folded over the longitudinal edges of said individual sheets;

second glue lines securing said ply longitudinal edges to said sheet longitudinal edges;

said control punch margins being reverse folded away from said sheets to extend to the sides of the respective sheet longitudinal edges.

2. The continuous envelope assembly of claim 1 wherein said folded over ply longitudinal edges extend sufficiently inwardly as to substantially fully overlie the die cuts on the corresponding side of the assembly.

3. The continuous envelope assembly of claim 1 further including means defining fold lines in said ply adjacent the edges of said sheets remote from said first glue lines to facilitate folding of said envelope flaps and adhesive on said envelope flaps.

4. A continuous envelope assembly comprising:

an elongated ply of paper having control punch margins along longitudinal edges thereof;

individual envelopes in said assembly being delimited by transverse lines of weakening extending across said assembly;

first glue lines on said ply adjacent said lines of weakening on one side thereof;

individual sheets having widths less than said ply secured thereto by said first glue lines;

said ply longitudinal edges being folded over the longitudinal edges of said individual sheets;

second glue lines securing said ply longitudinal edges to said sheet longitudinal edges;

said control punch margins being reverse folded away from said sheets to extend to the sides of the respective sheet longitudinal edges.

5. A continuous envelope assembly comprising:

an elongated ply of paper having control punch margins along longitudinal edges thereof;

individual envelopes in said assembly being delimited by transverse lines of weakening extending across said assembly;

die cuts in said ply adjacent both longitudinal edges thereof and adjoining said lines of weakening at one side thereof to define the corners of the envelope flap;

first securing means on said ply adjacent said lines of weakening and on the sides thereof opposite said die cuts;

individual sheets having widths less than said ply and length less than the distance between lines of weakening secured to said ply by said first securing means;

said ply longitudinal edges being folded over the longitudinal edges of said individual sheets;

second securing means securing said ply longitudinal edges to said sheet longitudinal edges;

said control punch margins being reverse folded away from said sheets to extend to the sides of the respective sheet longitudinal edges.

* * * * *